US007909948B2

(12) United States Patent
Kondoh et al.

(10) Patent No.: US 7,909,948 B2
(45) **Date of Patent: *Mar. 22, 2011**

(54) ALLOY POWDER RAW MATERIAL AND ITS MANUFACTURING METHOD

(75) Inventors: Katsuyoshi Kondoh, Minoh (JP); Mitsuhiro Goto, Otsu (JP); Hideaki Fukui, Kasukabe (JP); Shuji Shiozaki, Osaka (JP); Hajime Agata, York, PA (US); Katsuhito Itakura, Sakai (JP); Kazunori Fukumoto, Osaka (JP)

(73) Assignees: Gohsyu Co., Ltd., Shiga (JP); Kurimoto, Ltd., Osaka (JP)

( * ) Notice: Subject to any disclaimer, the term of this patent is extended or adjusted under 35 U.S.C. 154(b) by 920 days.

This patent is subject to a terminal disclaimer.

(21) Appl. No.: 10/592,877

(22) PCT Filed: May 21, 2004

(86) PCT No.: PCT/JP2004/006967

§ 371 (c)(1),
(2), (4) Date: Jul. 13, 2007

(87) PCT Pub. No.: WO2005/087410

PCT Pub. Date: Sep. 22, 2005

(65) Prior Publication Data

US 2008/0038573 A1 Feb. 14, 2008

(30) Foreign Application Priority Data

Mar. 15, 2004 (JP) ..... 2004-072411

(51) Int. Cl.
*B22F 1/00* (2006.01)

(52) U.S. Cl. ..... 148/513; 75/710; 241/23

(58) Field of Classification Search ..... 148/513
See application file for complete search history.

(56) References Cited

U.S. PATENT DOCUMENTS 2,791,498 A * 5/1957 Brundin et al. ..... 75/352
2,873,225 A * 2/1959 Adams et al. ..... 148/105
3,179,516 A * 4/1965 Cross ..... 419/32
3,407,062 A * 10/1968 Matthews et al. ..... 419/23
4,474,715 A * 10/1984 Weber et al. ..... 264/3.1

(Continued)

FOREIGN PATENT DOCUMENTS

GB 1032482 6/1966

(Continued)

OTHER PUBLICATIONS

Sotiri Papoulias, "Carbonyl Iron Powders," ASM Handbooks Online, vol. 7, 2002.*

(Continued)

*Primary Examiner* — Roy King
*Assistant Examiner* — Christopher Kessler
(74) *Attorney, Agent, or Firm* — Clark & Brody

(57) ABSTRACT

When starting raw material powder is passed through a pair of rolls (2*a*), plastic working is applied to the starting raw material powder, and the crystal grain diameter of a metal or alloy constituting a matrix of the powder particle after processed is miniaturized. According to the thus provided alloy powder raw material, the maximum size of the powder particle is not more than 10 mm and the minimum size of the powder particle is not less than 0.1 mm, and the maximum crystal grain diameter of the metal or alloy constituting the matrix of the powder particle is not more than 30 μm.

11 Claims, 7 Drawing Sheets

U.S. PATENT DOCUMENTS

| | | | | |
|---|---|---|---|---|
| 5,078,962 | A * | 1/1992 | Regazzoni et al. | 420/402 |
| 5,292,186 | A * | 3/1994 | Kubo et al. | 366/97 |

FOREIGN PATENT DOCUMENTS

| | | |
|---|---|---|
| JP | 3-90530 | 4/1991 |
| JP | 4-231435 | 8/1992 |
| JP | 5-320715 | 12/1993 |
| JP | 6-172949 | 6/1994 |
| JP | 8-269589 | 10/1996 |
| JP | 10-195502 | 7/1998 |
| JP | 2000-87199 | 3/2000 |
| JP | 2001-294966 | 10/2001 |
| JP | 2001-303150 | 10/2001 |
| JP | 2002-129208 | 5/2002 |
| JP | 2002-249801 | 9/2002 |
| JP | 2002-256307 | 9/2002 |
| JP | 2002-317236 | 10/2002 |
| JP | 2003-277899 | 10/2003 |
| JP | 2003-313623 | 11/2003 |
| WO | WO 03/027342 A1 | 4/2003 |

OTHER PUBLICATIONS

Jorge Simão et al., "Surface alloying using PM composite electrode materials when electrical discharge texturing hardened AISI D2," Journal of Materials Processing Technology, vol. 127, Issue 2, Sep. 30, 2002, pp. 211-216.*

J.A. del Valle et al., "Texture evolution during large-strain hot rolling of the Mg AZ61 alloy" (2003) *Materials Science and Engineering*, vol. 355(1-2), p. 68-78.

M. Nakanishi et al., "Tensile properties of the ZK60 magnesium alloy produced by hot extrusion of machined chip" (1998) *Journal of Materials Science Letters*, vol. 17(23), p. 2003-2005.

* cited by examiner (a) sample number 1

20 μm (b) sample number 4

20 μm (c) introduced raw material AM60 chip

200 μm (a) sample number 23

20 μm (b) sample number 24

20 μm

ALLOY POWDER RAW MATERIAL AND ITS MANUFACTURING METHOD

TECHNICAL FIELD

The present invention relates to an alloy powder raw material having a fine crystal grain and its manufacturing method. More particularly, according to the present invention, in order to manufacture a magnesium alloy having both high strength and high ductility, a magnesium crystal grain constituting the matrix of a magnesium-based alloy powder that is a raw material is to be miniaturized.

BACKGROUND ART

Since a magnesium alloy provides a weight saving effect because of its low specific gravity, it is widely used as an outer housing of a mobile phone or a portable audio equipment, a car component, a machine component, a structural material and the like. In order to further provide the weight saving effect, the magnesium alloy has to have both higher strength and ductility. In order to improve the above characteristics, the composition and component of the magnesium alloy is to be provided appropriately, and magnesium crystal grain constituting a matrix is to be miniaturized. Especially, regarding the miniaturization of the crystal grain of the magnesium alloy material, methods such as a rolling method, an extruding process method, a forging process method, a drawing process method, an ECAE (Equal Channel Angular Extrusion) method and the like have been used based on a plastic working process.

Japanese Unexamined Patent Publication No. 2001-294966 (patent document 1) discloses "magnesium alloy sheet, its manufacturing method and a product using the same". According to the method disclosed in this document, a molten magnesium alloy is injected to mold a plate, and the plate is compressed and deformed by rolling and the plate is heat-treated to be re-crystallized to miniaturize a magnesium crystal grain.

Japanese Unexamined Patent Publication No. 2000-087199 (patent document 2) discloses "manufacturing method of rolled product of magnesium alloy, method of press working magnesium alloy, and press worked product". According to the method disclosed in this document, a magnesium alloy plate is cold rolled at a predetermined reduction ratio of cross-sectional area and then the plate is heat-treated within a predetermined temperature range, so that the magnesium crystal grain is miniaturized due to re-crystallization.

According to methods disclosed in Japanese Unexamined Patent Publication No. 2001-294966 and Japanese Unexamined Patent Publication No. 2000-087199, an object to be processed is a plate material and the finally provided material is a plate material. Therefore, it is extremely difficult to manufacture a pipe material, a rod material and a material having a irregular configuration in section by the method disclosed in the above documents. In addition, it is necessary to perform a heat treatment after a rolling process, so that the cost of the material is increased.

Japanese Unexamined Patent Publication No. 2003-277899 (patent document 3) discloses "magnesium alloy member and its manufacturing method". According to the method disclosed in this document, magnesium crystal grain is miniaturized by a first forging process, an aging heat treatment and a second forging process after a magnesium alloy material is solution heat treated. In this method also, since it is necessary to repeat the forging process and heat treatment several times, the cost for the material is increased. In addition, since it is essential that a predetermined process prestrain is applied to the material in the first forging process, there is a limit in product configuration. Furthermore, the method disclosed in this document is not suitable for manufacturing a long size product such as a rod material or a pipe-shaped material.

International Publication WO03/027342A1 (patent document 4) discloses "magnesium-based complex material". According to the method disclosed in this document, magnesium alloy powder or magnesium alloy chip is prepared as a starting raw material and this raw material is inputted in a mold mill and compression molding and extruding process are performed repeatedly to form a solidified billet of the powder or chip. Then, the hot plastic working is applied to the billet to provide high-strength magnesium alloy having a fine magnesium crystal grain. According to the method disclosed in this document, when a large solidified billet is manufactured, it is difficult to finely granulate the crystal grain uniformly. In addition, since it is necessary to considerably increase the number of processes of the compression and extrusion in order to make progress the fine granulation, the cost for the material becomes high.

Japanese Unexamined Patent Publication No.5-320715 (patent document 5) discloses "manufacturing method of magnesium alloy member". According to the method disclosed in this document, the cuttings, scrap, waste product and the like discharged when the magnesium alloy member is cut are compressed and solidified and it is extruded or forged to manufacture a magnesium alloy member with a history of plastic working. At this time, the strength of the magnesium alloy is increased by urging the miniaturization of magnesium crystal grain by the plastic working.

In the above method, the crystal grain diameter of a magnesium matrix that determines the strength characteristics of the magnesium alloy after extruded or forged is strongly related not only to a strain amount applied to the raw material at the time of plastic working but also to the crystal grain diameter of the cuttings, scrap, waste product or the magnesium matrix of the forging material used as the starting raw materials. That is, the crystal miniaturization of the magnesium constituting the matrix of the starting raw material is extremely effective to increase the strength of the magnesium alloy material that is the final product. However, the crystal grain diameter of magnesium in the cutting, scrap, waste product or forging material used here is as huge as several hundreds micron. Therefore, it cannot implement considerable high strength and ductility in the magnesium alloy provided when the cuttings, scrap, waste material or forging material of the normal magnesium alloy are used as the starting raw material.

Meanwhile, focusing on a miniaturizing method of a magnesium crystal grain in a magnesium alloy powder that is one starting raw material, there is a rapidly quenching solidification process executed by a spray method or a single-roll method. According to the above method, while a molten magnesium alloy liquid drop is cooled and solidified for an extremely short time, the growth of the crystal grain is prevented, so that the magnesium-based alloy powder grain having fine crystal grain can be manufactured.

A cooling and solidifying rate depends on a cooled amount on the liquid drop surface. Namely, it depends on the specific surface area of the magnesium alloy liquid drop, so that the fine the liquid drop is, the higher the solidification rate and it can be solidified for a short time. As a result, the magnesium alloy powder has a fine crystal grain. Therefore, although the magnesium-based alloy powder having the fine crystal grain can be manufactured by the rapidly quenching method, since the crystal grain diameter becomes small on the other hand, the powder particle is likely to float during the manufacturing process, so that it is highly likely that dust explosion occurs. In addition, in a case of compression and solidification by die press molding, since fluidity is low in the fine powder particle, filling efficiency to the die is lowered and a space is partially formed and since the friction between the powder is increased, it is not likely to be solidified.

As described above, in order to implement the high ductility of the magnesium alloy, miniaturization of the magnesium crystal grain of the matrix is effective. In this case, first, a manufacturing method such as a forging method or die-casting method that does not go through a melting and solidifying process that involves the grain growth is required. More specifically, it is an issue to establish a solid phase process that molds and densely solidifies powder or a raw material having a geometric configuration similar to the powder within a temperature range below its melting point.

Next, it is necessary to make fine the crystal grain of the magnesium-based alloy powder used as a raw material at that time. At the same time, it preferably is relative coarse powder so as not to cause the dust explosion, and has an appropriate size in view of the press forming.

DISCLOSURE OF THE INVENTION

It is an object of the present invention to provide an alloy powder raw material in which the particle diameter of the powder itself is large but the crystal grain of a metal or alloy constituting the matrix of the powder is fine, and its manufacturing method.

The inventors of the present invention have studied the above issue energetically and repeated many experiments, and finally found the following means for solving the issue. That is, they found a relatively coarse alloy powder raw material in which a risk of dust explosion and the like is not caused and a maximum crystal grain diameter of a metal or alloy constituting a matrix of the powder particle is as fine as 30 u m, and its manufacturing method.

Although the inventors of the present invention conducted experiments on the magnesium-based alloy powder raw material, the present invention can be applied to another material powder such as an aluminum-based alloy powder raw material and the like. In addition, it was confirmed from the experiments that a magnesium alloy provided by molding and solidifying the above magnesium-based alloy powder raw material has both excellent strength and ductility.

Although the terms "metal" and "alloy" are used in this specification, both are not strictly in distinction to each other. According to this specification, the terms "metal" or "alloy" are to be understood to include both pure metal and alloy.

The present invention to attain the object is as follows.

According to an alloy powder raw material of the present invention, the maximum size of the powder particle is not more than 10 mm and the minimum size of the powder particle is not less than 0.1 mm and the maximum crystal grain diameter of a metal or alloy constituting the matrix of the powder particle is not more than 30 μm.

The metal or alloy constituting the matrix of the powder is magnesium or a magnesium alloy. Preferably, the maximum size of the powder particle is not more than 6 mm and the minimum size of the powder particle is not less than 0.5 mm. More preferably, the maximum crystal grain diameter of the magnesium or magnesium alloy constituting the matrix of the powder particle is not more than 15 μm.

According to one embodiment, plastic working is applied to a starting raw material powder having a relatively large crystal grain diameter so that the raw material of the powder may have a relatively small diameter. According to another embodiment, the raw material of the powder is obtained from a metal or alloy material having a matrix in which the maximum crystal grain diameter is 30 μm or less by executing a machining process of cutting, shearing or grinding.

According to one aspect, a manufacturing method of an alloy powder raw material is characterized in that a starting raw material powder is processed by plastic working to miniaturize the crystal grain diameter of a metal or alloy constituting the matrix of the starting raw material powder.

Preferably, the plastic working is performed until the maximum size of the powder particle becomes 10 mm or less, the minimum size thereof becomes 0.1 mm or more and the maximum crystal grain diameter of the metal or alloy constituting the matrix of the powder particle becomes 30 μm or less. Alternatively, when it is assumed that the maximum crystal grain diameter of the metal or alloy constituting the matrix of the starting raw material powder particle is 100%, the plastic working is performed until the maximum crystal grain diameter of the metal or alloy constituting the matrix of the powder particle after processed becomes 20% or less.

Preferably, the plastic working is performed at 300° C. or lower. In addition, preferably, the starting raw material powder is heated in an inert gas atmosphere, a non-oxygenated gas atmosphere or a vacuum atmosphere. For example, the starting raw material powder is magnesium or magnesium alloy powder.

According to one embodiment, the plastic working is performed such that the starting raw material powder is compressed and deformed through a pair of rolls. As a more concrete aspect, the pair of rolls is arranged in a case, and the method further comprises a raw material inputting step of continuously inputting the starting raw material powder to the space between the pair of rolls in the case, and a powder discharging step of continuously discharging the powder processed by the plastic working between the pair of rolls outside the case. A step of processing the powder discharged from the case in at least one machine of a crushing machine, a grinding machine, and a granulating machine continuously to provide granular powder may be provided.

A plurality of the pairs of rolls may be provided and the starting raw material powder is processed by plastic working through the plurality of pairs of rolls. For example, the clearance between the pair of rolls is not more than 2 mm.

Preferably, the surface temperature of the roll with which the starting raw material powder comes into contact is set to 300° C. or lower. In addition, preferably, a region in which the plastic working is applied including the pair of rolls is in an inert gas atmosphere, a non-oxygenated, or a vacuum atmosphere. The roll has a recessed part on its surface.

According to another embodiment, the plastic working is performed by kneading the starting raw material powder. As a more concrete embodiment, the plastic working is performed by inputting the starting raw material powder into a case in which a pair of rotation paddles is arranged and kneading it. In this case, there may be provided a raw material inputting step of inputting the starting raw material powder continuously into the case, a kneading step of kneading the starting raw material powder in the case, and a powder discharging step of continuously discharging the kneaded powder outside the case. There may be provided a step of processing the powder discharged from the case in at least one machine of a crushing machine, a grinding machine and a granulating machine to provide granular powder.

A plurality of the pair of paddles may be provided and the starting raw material powder is kneaded by the plurality of pairs of paddles. For example, the clearance between the pair of paddles is not more than 2% of the paddle diameter, or not more than 20% of the starting raw material powder size, or not more than 2 mm. In addition, the clearance between the paddle and the case is not more than 2% of a paddle diameter, or not more than 20% of a starting raw material powder size, or not more than 2 mm.

Preferably, the surface temperature of the paddle with which the starting raw material powder comes into contact is set to 300° C. or lower. In addition, preferably, the surface temperature of the inner wall of the case with which the starting raw material powder comes into contact is set to 300° C. or lower. Further preferably, the case is in an inert gas atmosphere, a non-oxygenated atmosphere, or a vacuum atmosphere.

According to another aspect, a manufacturing method of the alloy powder raw material of the present invention comprises a step of preparing a material having a configuration of a plate, a rod, a pillar, or a lump in which the maximum crystal grain diameter of a metal or alloy constituting a matrix is not more than 30 μm, and a step of performing machining process such as cutting, shearing, grinding or the like for said material and obtaining a powder raw material in which a maximum size is not more than 10 mm and a minimum size is not less than 0.1 mm from the material.

BEST MODE FOR CARRYING OUT THE INVENTION

Embodiments and interaction effects of the present invention will be described hereinafter.

Figure 1:
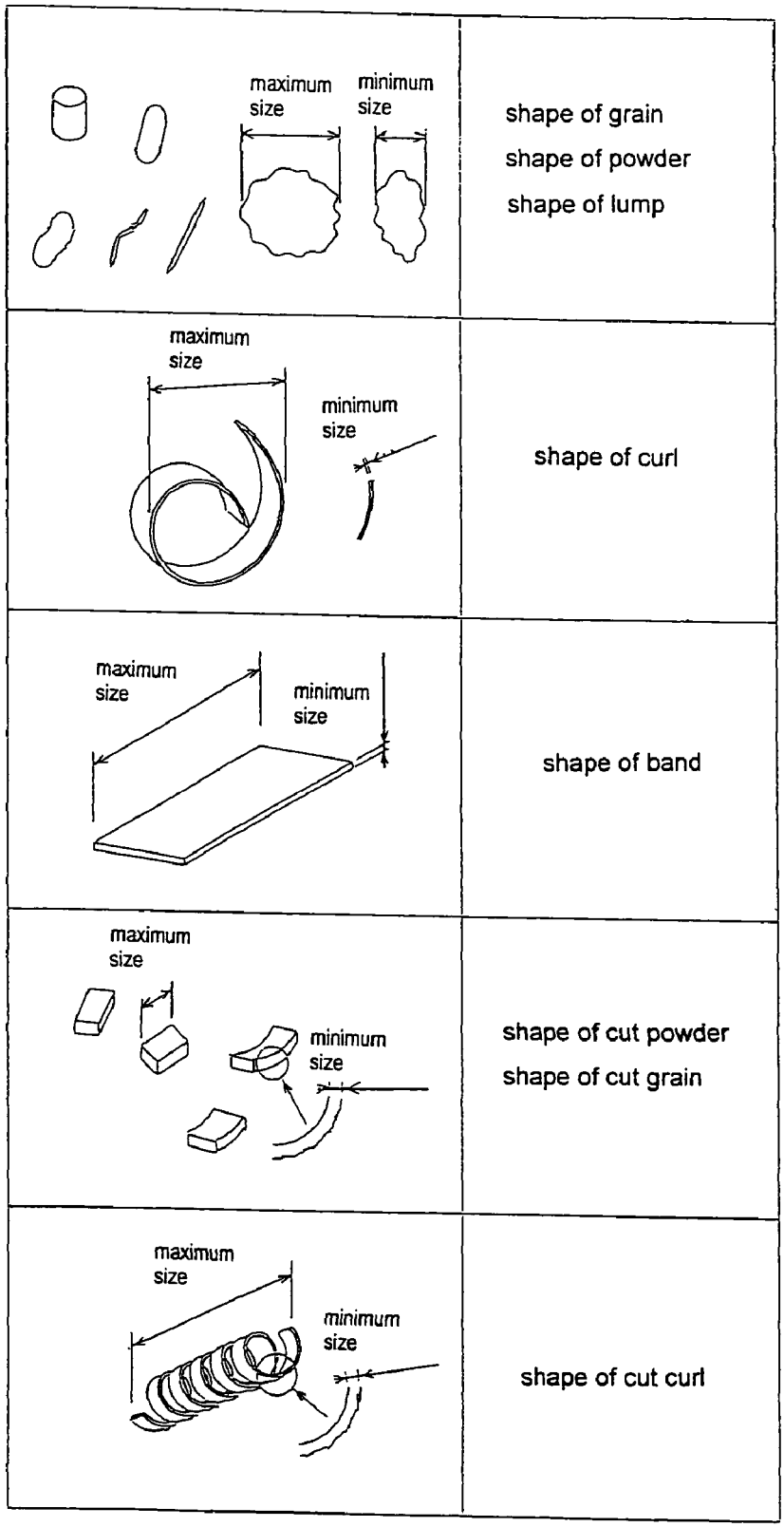
FIG. 1 is a view showing various kinds of configurations of powder raw materials.

(1) Magnesium-Based Alloy Powder Raw Material (A) Configuration of Powder Raw Material A continuous plastic working is performed for the magnesium-based alloy powder raw material to miniaturize a crystal grain of the magnesium-based alloy powder with efficiently. To promote the miniaturization, it is preferable that a starting raw material powder to be used has a configuration of particle, powder, lump, curl, band, cut powder, cut curl or cut grain. These configurations are shown in FIG. 1.

The plastic working includes compressing, shearing, grinding, kneading and the like, and the powder provided after the process is the powder or its aggregate similar to that used as the starting material. When crushing is performed according to need, compression molding and solidification can be easily performed.

More specifically, an appropriate compression molding property and a solidification property are required for the magnesium-based alloy powder after the plastic working and when the magnesium-based alloy powder is solidified in a mold mill, it is necessary to improve a fluidity property of the powder and a filling property thereof in the mold. In order to improve these characteristics also, it is preferable the magnesium-based alloy powder having the configuration of the grain, powder, lump, curl, band, cut powder, cut curl or cut grain is used.

(B) Powder Raw Material Size

According to the magnesium-based alloy powder raw material provided by the method of the present invention, the powder particle has a maximum size of 10 mm or less. Here, the maximum size is the biggest dimension of the powder particle and in the case of the shape of grain, powder, lump, or cut grain, it corresponds to the maximum particle diameter. In the case of the shape of band, it means the longest dimension of its width, length or thickness. In the case of the shape of curl, it corresponds to the diameter when the curl is assumed as a circle.

When the maximum size of the magnesium-based alloy powder particle is 10 mm or less, there is no problem in the above compression molding property, solidification property, fluidity property and mold filling property. The more preferable maximum size is 6 mm or less. When the maximum size of the powder particle exceeds 10 mm, these characteristics are lowered and especially the compression molding property is lowered, causing a solidified billet to be cracked.

On the other hand, according to the magnesium-based alloy powder raw material provided by the method of the present invention, the minimum size of the powder particle is 0.1 mm or more. Here, the minimum size is the smallest dimension of the powder particle. In the case of the shape of grain, powder, lump or cut grain, it corresponds to the minimum particle diameter. In the case of shape of band, it means the smallest dimension of the width, length or thickness. In the case of the shape of curl, it is the smallest dimension of the width or thickness of the material constituting the curl.

When the minimum size of the magnesium-based alloy powder particle of the present invention is 0.1 mm or more, there is no problem in the above-described compression molding property, solidification property, fluidity property, mold filling property. A more preferable minimum size is 0.5 mm or more. When the minimum size of the powder particle is not more than 0.1 mm, the powder characteristics regarding the compression molding and solidification are lowered and there is a risk of increasing possibility of dust explosion due to floating of the powder.

FIG. 1 shows a part of the maximum size and a part of the minimum size with respect to each powder particle configuration.

(C) Maximum Crystal Grain Diameter of Magnesium Constituting Matrix of Powder Particle According to the magnesium-based alloy powder provided by the method of the present invention, the maximum crystal grain diameter of the magnesium is 30 μm or less. Here, the maximum crystal grain diameter is the diameter of the circumcircle of the crystal grain. More specifically, it means the biggest diameter of the crystal grain observed by an optical microscope and the like after the crystal grain boundary has been cleared through wet polishing with an abrasive grain and etching.

In order to improve the mechanical characteristics such as strength or hardness, it is necessary not only to miniaturize the average crystal diameter of the grain constituting the matrix, but also to miniaturize the maximum crystal grain diameter. Thus, according to the present invention, it is found that the magnesium-based alloy powder having both excellent strength and ductility can be produced by keeping the maximum crystal grain diameter of the magnesium within an appropriate range.

On the other hand, when the maximum crystal grain diameter of the magnesium constituting the matrix exceed 30 μm, the provided magnesium-based alloy cannot have the balanced strength and ductility, and mechanical characteristics of either of them or both of them are lowered. More preferably, the maximum crystal grain diameter of the magnesium grain in the magnesium-based alloy powder raw material is 15 μm or less.

The magnesium-based alloy powder raw material having the above-described constitution can be provided by the plastic working or machining process to the starting material powder. More specifically, according to one method, the plastic working is performed for the starting raw material powder having a relatively large crystal grain diameter so that the powder raw material has a small crystal grain diameter becomes small. According to another method, the powder raw material is provided from a metal or alloy material having a matrix in which a maximum crystal grain diameter is 30 μm or less by performing a machining process of cutting, shearing or grinding.

The magnesium-based alloy powder raw material is one of the embodiment of the alloy powder raw material according to the present invention. The present invention can be applied to another material such as an aluminum-based alloy powder raw material and the like. This is similar to the method as will be described below.

Figure 2:
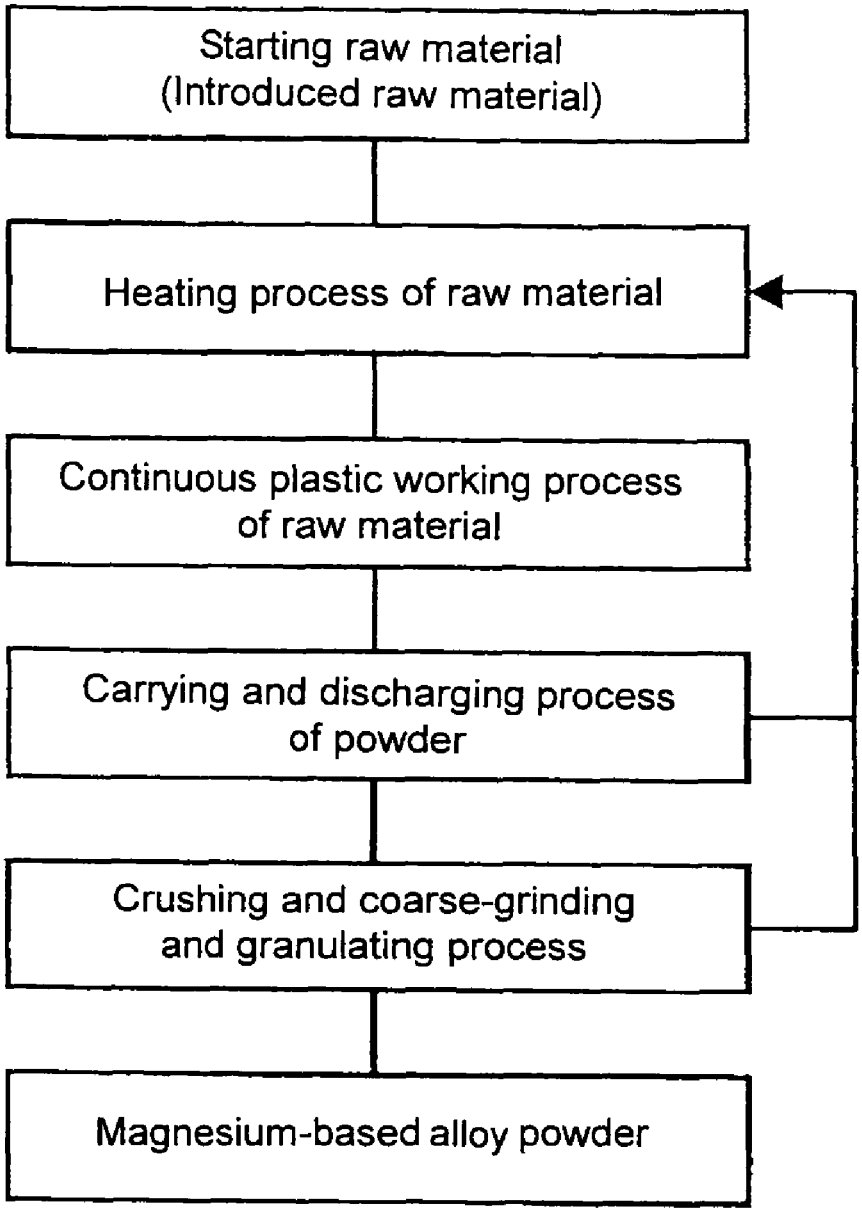
FIG. 2 is a view sequentially showing manufacturing steps according to the method of the present invention.

(2) Manufacturing Method of Magnesium-Based Alloy Powder Raw Material by Plastic Working FIG. 2 shows the manufacturing steps of the magnesium-based alloy powder raw material by the plastic working step by step.

(A) Heating Process of Raw Material

In the continuous plastic working of the starting raw material, since the temperature of the raw material at the time of the process has a close relation to fine granulation of the magnesium crystal grain, it is necessary to keep the temperature within an appropriate range. Therefore, it is important to heat and keep the raw material powder at the predetermined temperature previous to the plastic working. For the reason described below, it is desirable that the temperature of the powder is not more than 300° C. and it is more desirable that the temperature is 100 to 200° C.

When the input raw material is plastically deformed within the above temperature, the crystal grain scissoring and recrystallization can make rapid progress by a high straining process that is a driving source of the fine granulation of the crystal grain. Although the continuous plastic working can be performed at the room temperature, since a defect such as dislocation introduced to the raw material due to the high straining process is increased and the raw material powder becomes brittle and it is grounded and finely granulated in the course of the process, it is highly likely that the dust explosion is caused.

When the starting raw material powder is processed by plastic working within the temperature range of 100 to 200° C., the ductile powder raw material after the process is prevented from being grounded and finely granulated and at the same time, the magnesium crystal grain can be finely granulated. Meanwhile, when the plastic working is performed at the temperature beyond 300° C., seizing and cohesive phenomenon between a rotation body for the plastic working and the raw material is generated.

In view of preventing oxidation of the powder surface during the heating process of the starting raw material, it is desirable that the starting raw material powder is heated in an inert gas atmosphere, a non-oxygenated atmosphere, or a vacuum atmosphere. For example, when the starting raw material powder is heated in the air atmosphere, an oxide exists in the magnesium-based alloy after a hot extruding process or a forging process that is a subsequent process because the powder surface is oxidized, so that characteristic lowering such as fatigue strength could occur.

(B) Continuous Plastic Working Process of Raw Material

Figure 3:
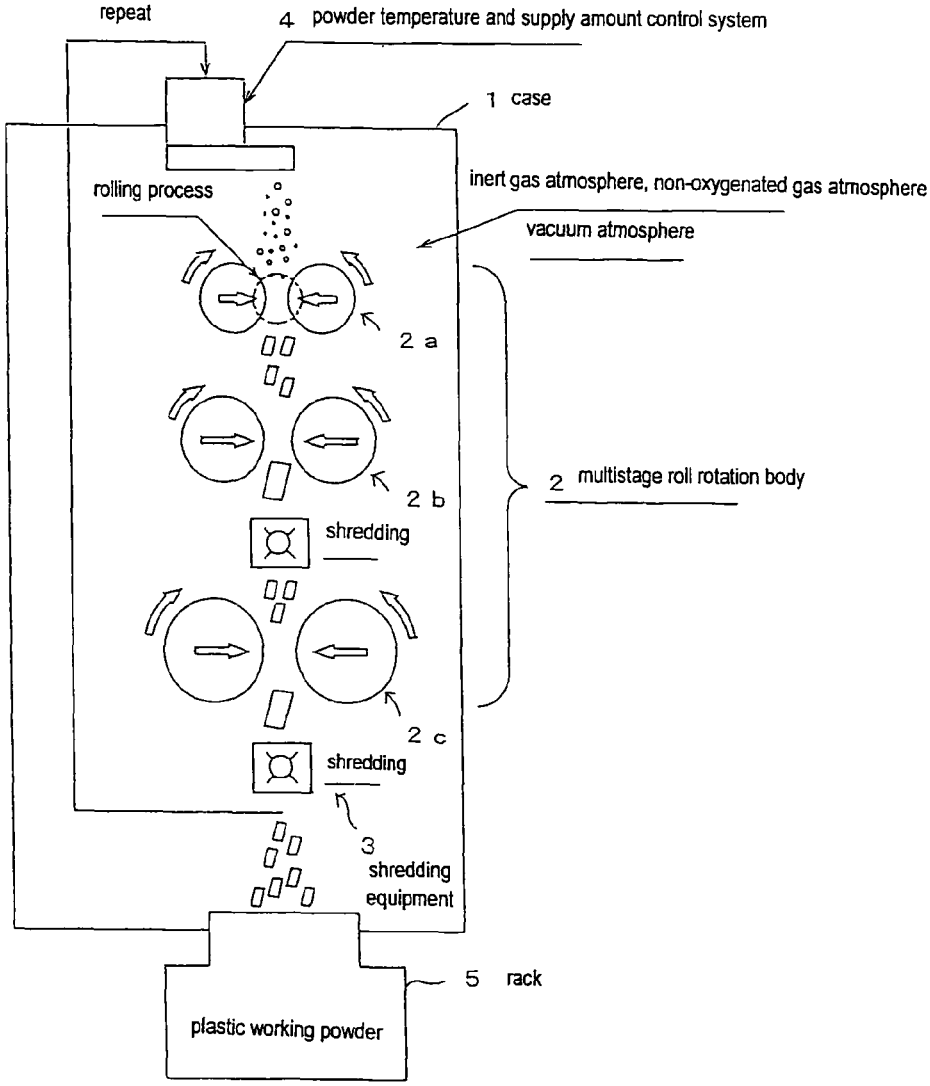
FIG. 3 is a schematic view showing a roller compactor as one example of a continuous powder plastic working apparatus.
Figure 4:
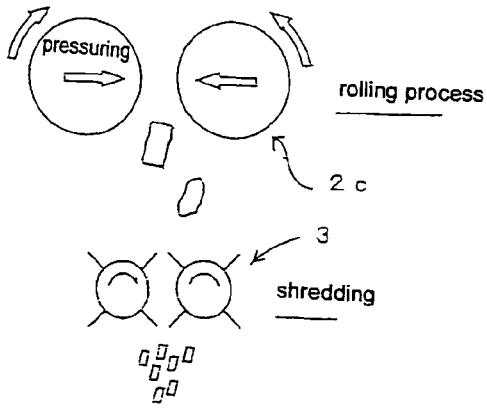
FIG. 4 is a view showing a third roll pair and a crushing machine in the continuous powder plastic working machined shown in FIG. 3.
Figure 5:
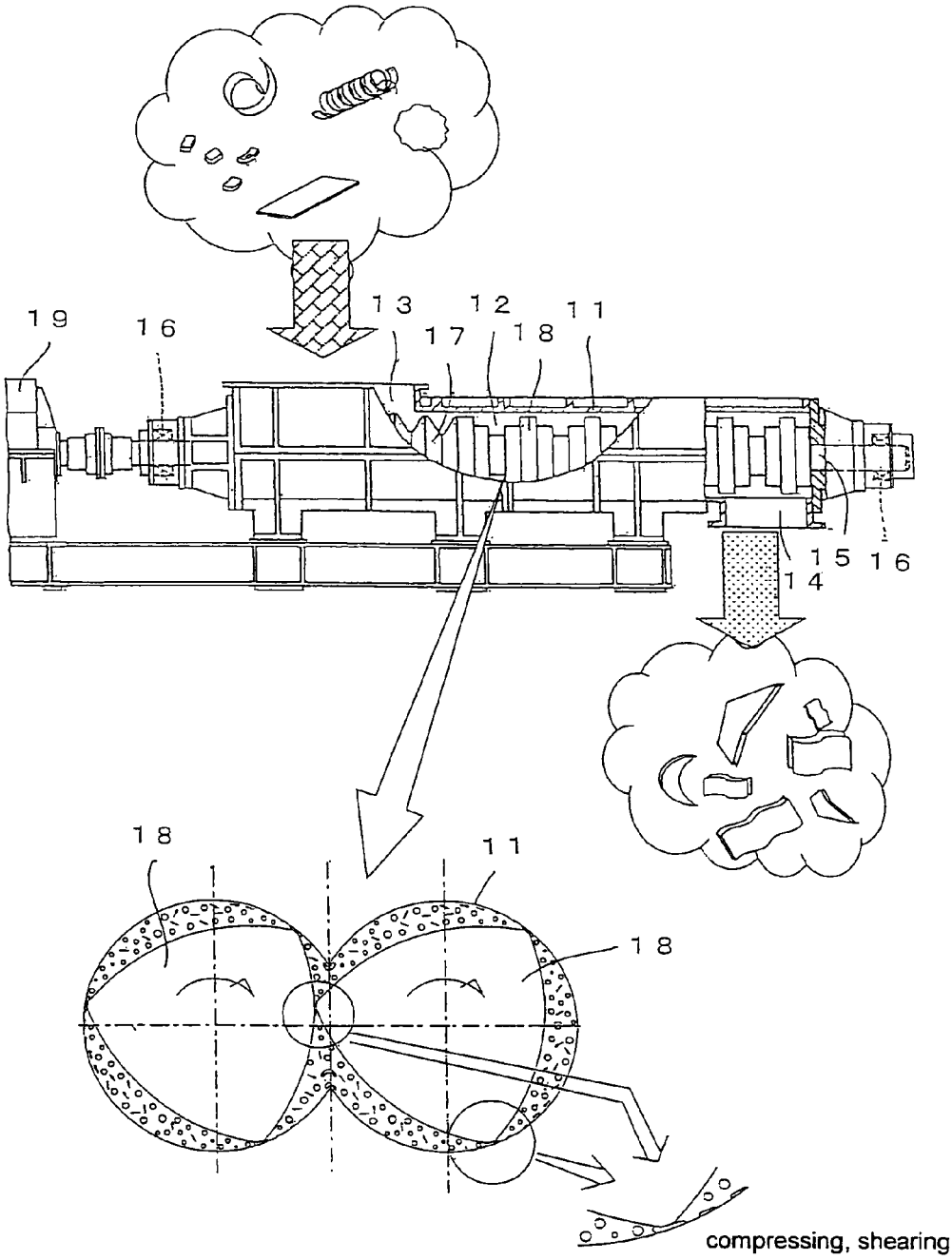
FIG. 5 is a view showing a forging machine as another example of a continuous powder plastic working machine.
Figure 6:
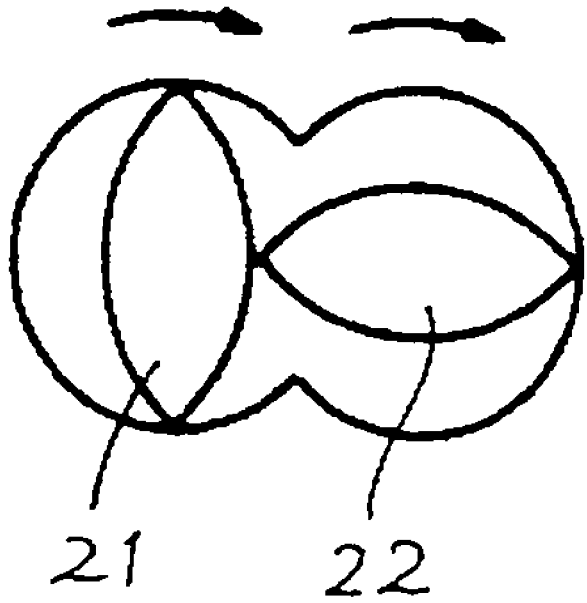
FIG. 6 is a view showing another example of a pair of paddles in the continuous powder plastic working machine shown in FIG. 5.
Figure 7:
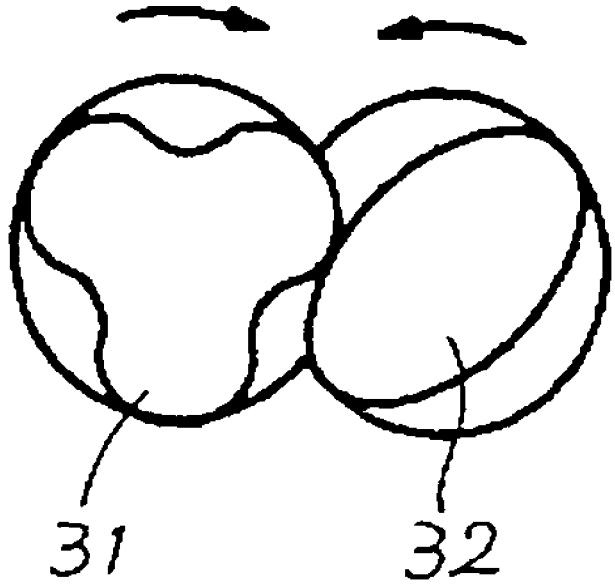
FIG. 7 is a view showing still another example of a pair of paddles in the continuous powder plastic working machine shown in FIG. 5.

FIGS. 3 and 4 show a roller compactor that is one example of a continuous powder plastic working apparatus, and FIGS. 5 to 7 show a kneader (kneading machine) that is another example of the continuous powder plastic working apparatus. First, these apparatus constitutions will be briefly described.

The continuous powder plastic working apparatus shown in FIG. 3 comprises a case 1, a multistage roll rotation body 2 arranged in the case 1, a shredding equipment 3, a powder temperature and supply amount control system 4, and a rack 5. The multistage roll rotation body 2 comprises pairs of rolls 2*a*, 2*b* and 2*c* for rolling the starting raw material powder. The starting raw material powder is compressed and deformed when it passes through the pair of rolls.

The temperature and the amount of the starting raw material powder is adjusted to the predetermined ones by the powder temperature and supply amount control system 4 and inputted to the case 1. The case 1 is kept in the inert gas atmosphere, the non-oxygenated gas atmosphere or the vacuum atmosphere in view of preventing the powder surface from being oxidized.

FIG. 4 shows the third-stage roll pair 2*c* and the shredding equipment 3. The powder coming from the roll pair 2*c* is shredded by the shredding equipment 3 continuously and becomes granular powder. This granular powder may be returned to the powder temperature and supply amount control system 4 again and the plastic working may be repeated by the multistage roll rotation body 2. The processed granular powder is housed in the rack 5.

The continuous powder plastic working apparatus shown in FIG. 5 comprises a case 11 having a kneading chamber 12 kept in the inert gas atmosphere, the non-oxygenated atmosphere or the vacuum atmosphere, a supply port 13 for receiving the starting raw material powder and a discharge port 14 from which the kneaded powder is discharged. In the case 11, two rotation shafts 15 rotatably supported by bearings 16 and driven by a driving unit 19 are arranged. A screw 17 for sending the starting raw material powder introduced in the case 11 forward and a paddle 18 for kneading the starting raw material powder are fixed to each rotation shaft 15. In order to heat the case 11, a jacket that can supply a heater or a heating medium may be provided for the case 11. In addition, in order to heat the rotation shaft 15, an apparatus that can supply a heater or a heating medium may be provided for the rotation shaft 15.

The starting raw material powder sent to the kneading chamber 12 by the screw 17 is kneaded when it passes through the pair of rotation paddles 18 and a space between each paddle 18 and the inner wall surface of the case 11. In this kneading process, compressing force, shearing force, dispersing force, impact force, deforming force, grinding force and the like are applied to the starting raw material powder. In addition, the plurality of pairs of rotation paddles 18 are provided.

According to the embodiment shown in FIG. 5, the pair of paddles 18 rotate in the same direction. In addition, each paddle 18 has a configuration having three sharp apexes. Each of FIGS. 6 and 7 shows another pair of paddles having a configuration different from the paddle 18 shown in FIG. 5. Each of paddles 21 and 22 shown in FIG. 6 has a configuration having two sharp apexes and rotates in the same direction. Paddles 31 and 32 shown in FIG. 7 have configurations different from each other and rotate in the opposite directions. Although there are various kinds of paddles as described above, the kneading process may be performed using any kind of paddle.

The continuous powder plastic working apparatus shown in FIGS. 3 or 5 comprises the pair of rotation bodies and the plastic working such as the compressing, shearing and grinding is applied to the starting raw material powder supplied between the rotation bodies and the rotation body and the case, while the crystal grain is finely granulated by the above-describe high strain process.

As describe above, since it is important to control the temperature of the raw material powder at the time of plastic working, it is necessary to keep the temperature of the pair of rotation body surfaces and/or the temperature of the surface of the case inner wall within an appropriate range. The temperature range is preferably not more than 300° C. similar to the above heating and retention temperature of the raw material powder, and more preferably 100 to 200° C. for the same reason described above.

When the plurality of pairs of rotation bodies are provided in the continuous powder plastic working apparatus, the high strain can be applied to the raw material powder. In addition, a method in which the raw material powder after the plastic working is heated to the predetermined temperature again and then introduced into the plastic working apparatus again to be processed and these are repeated several times is effective.

It is desirable that the clearance between the pair of rotation bodies and the clearance between the rotation body and the case in the continuous powder plastic working apparatus is set to appropriate values. In the case of the apparatus shown in FIG. 3, the clearance between the pair of rolls is preferable not more than 2 mm. In the case of the apparatus shown in FIG. 5, it is preferable that the clearance between the pair of paddles is not more than 2% of a paddle diameter or not more than 20% of the size of the starting raw material powder, or not more than 2 mm. Furthermore, it is also preferable that the clearance between the paddle and the case is not more than 2% of the paddle diameter, or not more than 20% of the maximum size of the starting raw material powder, or not more than 2 mm.

Although the raw material powder is continuously supplied to the clearance between the pair of rotation bodies or the clearance between the each rotation body and the case during the plastic working, when the clearance exceeds the above preferable values, sufficient strain process cannot be performed and as a result, the magnesium crystal grain having a size of 30 μm or less cannot be provided. Although the degree of working varies according to the size or the configuration of the introduced raw material powder, the continuous fine granulating of the magnesium crystal grain can be stably performed by setting the above clearance to be not more than ⅕ of the maximum size of the raw material powder.

The surface configuration of the pair of roll rotation bodies that comes into contact with the raw material powder in the continuous powder plastic working apparatus may be improved. More specifically, a recessed part is formed on the surface of the roll rotation body. The recessed part may be one or more recessed grooves or slits, and when they are provided so as to extend in perpendicular directions or a parallel direction or a direction crossing at an angle with respect to the rotation direction, the raw material powder can be effectively drawn into the space between the roll rotation bodies by an effect of a wedge and high straining process can be forcedly performed. However, the recessed part is not always provided and even when the roll rotation body does not have the above recessed groove or slit on its surface, the crystal grain can be finely granulated by the plastic working.

In order to prevent the raw material powder from being oxidized at the time of plastic working, a part or a whole containing the rotation body in the continuous powder plastic working apparatus is covered with a glow box and the like to keep the inert gas atmosphere, the non-oxygenated atmosphere or the vacuum atmosphere.

By performing the above plastic working for the starting raw material powder, the processed alloy powder raw material has the following characteristics. That is, according to the alloy powder raw material, the maximum crystal grain diameter of the alloy constituting the matrix of the powder is not more than 30 μm, or when it is assumed that the maximum crystal grain diameter of the alloy grain constituting the matrix of the starting raw material powder is 100%, the plastic working is performed until the maximum crystal grain diameter of the alloy grain constituting the matrix of the processed powder becomes 20% or less. If such crystal grain miniaturization cannot be implemented, it is difficult to implement both excellent strength and ductility in the magnesium-based alloy material formed of the processed powder by molding and solidifying process.

(C) Carrying and Discharging Process of Powder

The powder processed by the plastic working is continuously discharged from the case. When it is necessary to perform the plastic working several times, the powder is supplied to the heating process again to perform continuous plastic working. When the discharged powder is large, the powder is ground or granulated into appropriate dimension and configuration and then it is supplied to the heating process.

(D) Crushing and Coarse-Grinding and Granulating Process

As described above, the magnesium-based alloy powder raw material according to the present invention is compressed and solidified later. Therefore, appropriate compression molding property, solidification property, fluidity property and mold filling property are required. Since these properties depend on the dimension or the configuration of the powder, it is preferable that a crushing process, a coarse-grinding process and a granulating process are performed using a crushing machine, a grinding machine, a granulating machine for the powder discharged from the apparatus after the continuous plastic working, to homogenize the dimension (grain diameter) and the configuration thereof. In view of grinding workability, the temperature of the powder at that time is preferably the room temperature. According to the finally provided alloy powder raw material, the maximum size of the powder particle is not more than 10 mm and the minimum size of the powder particle is not less than 0.1 mm. The configuration of the powder is granulated powder, for example.

(3) Manufacturing Method of Magnesium-Based Alloy Powder Raw Material by Machining Process The magnesium-based alloy powder raw material according to the present invention can be manufactured by a machining process instead of the above-described plastic working.

According to this method, a material having the shape of a plate, rod, pillar, lump, in which a maximum crystal grain diameter of magnesium alloy constituting a matrix is 30 μm or less is prepared. That material is provided such that a rod-shaped, plate-shaped or lump-shaped magnesium-based alloy material that is a starting material is processed by a hot or warm plastic working such as rolling, extruding, forging and the like and highly strained. The maximum crystal grain diameter of the magnesium alloy constituting the matrix of the material is miniaturized to 30 μm or less and more preferably, the maximum crystal grain diameter of the magnesium alloy is miniaturized to 15 μm or less.

Then, a machining process such as cutting, shearing, grinding and the like is performed for the magnesium alloy material in which the crystal grain is miniaturized. Thus, from this material, a powder raw material having the maximum size of 10 mm or less and the minimum size of 0.1 mm or more is provided. The maximum crystal grain diameter of the magnesium alloy constituting the matrix of the provided powder is 30 μm or less and more preferably 15 μm or less. The size of the powder particle can be adjusted by adjusting the above machining process condition, that is, adjusting a cutting speed, selecting the quality and configuration of a tool, and adjusting a processing time when the material is ground by a ball mill, for example.

EXAMPLE 1

As a starting raw material, a AM60 (nominal composition: Mg-6% by weight of Al-0.5% by weight of Mn) alloy chip (its length is 3.5 mm, width is 1.5 mm, thickness is 1.2 mm, maximum crystal grain diameter of magnesium of matrix is 350 μm, and average Vickers hardness is 65.4 Hv) was prepared. In addition, a roller compactor having a pair of roll rotation bodies (its roll diameter is 66 mm ϕ, roll width is 60 mm, and clearance between rolls is 0.4 mm) was used as the continuous powder plastic working apparatus. The AM60 chip was retained at each temperature shown in Table 1 in a heating furnace kept in a nitrogen gas atmosphere and supplied to the working apparatus to be compressed and deformed. After the sample discharged from the apparatus had been ground and granulated in a batch apparatus, it is heated and retained at the predetermined temperature again as shown in the Table 1 and then continuously compressed and deformed by the same working apparatus.

In the Table 1, the number of passing corresponds to the number of times the AM60 chip is supplied to the roller compactor. The measured result of the configuration and the dimension of the provided powder sample are shown in the Table 1 and the measured result of a maximum crystal grain diameter and Vickers hardness observed by an optical microscope after polished and etched are shown in Table 2.

According to sample numbers 1 to 5 that are the examples of the present invention, the maximum crystal grain diameter of the matrix is miniaturized to 30 μm or less as compared with the AM60 chip of the introduced raw material, and it can be further miniaturized to 15 μm or less by setting the temperature condition appropriately. In addition, it is recognized that the Vickers hardness is increased by the high straining process.

According to a sample number 6 that is a comparison example, since the temperature of the introduced sample AM60 chip was heated to 330° C. that exceeds the proper temperature, the sample chip was attached on the roll surface during the plastic working process.

TABLE 1

| sample number | temperature of AM60 chip (° C.) | number of passing | characteristics of powder after batch process | |
|---|---|---|---|---|
| | | | configuration | dimension |
| 1 | room temperature | 1 | plate-shape | length 1.7 mm, width 1.8 mm, thickness 0.52 mm |
| 2 | 100 | 1 | plate-shape | length 2.3 mm, width 1.9 mm, thickness 0.54 mm |
| 3 | 150 | 1 | plate-shape | length 2.7 mm, width 1.8 mm, thickness 0.51 mm |
| 4 | 200 | 1 | plate-shape | length 3.3 mm, width 1.7 mm, thickness 0.53 mm |
| 5 | 280 | 1 | plate-shape | length 3.8 mm, width 1.8 mm, thickness 0.56 mm |
| 6 | 330 | 1 | plate-shape | length 4.3 mm, width 1.9 mm, thickness 0.57 mm |

TABLE 2

| sample number | characteristics of powder after batch process | | |
|---|---|---|---|
| | maximum crystal grain diameter | average hardness (Hv) | Other |
| 1 | 27 μm | 73.1 | No attachment on the roll surface |
| 2 | 16 μm | 82.6 | No attachment on the roll surface |
| 3 | 13 μm | 83.5 | No attachment on the roll surface |
| 4 | 11 μm | 84.2 | No attachment on the roll surface |
| 5 | 15 μm | 81.1 | No attachment on the roll surface |
| 6 | 24 μm | 74.5 | sample chip was attached on the roll surface |

Figure 8:
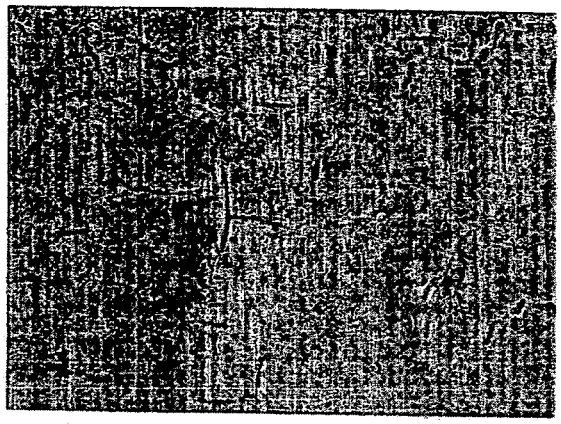
FIG. 8 shows optical micrographs of samples of sample numbers 1 and 4 in Tables 1 and 2, and an optical micrograph of an input raw material AM60 chip.
Figure 8:
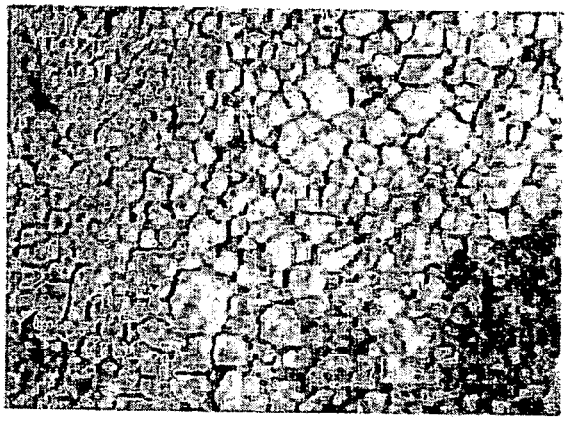
Figure 8:
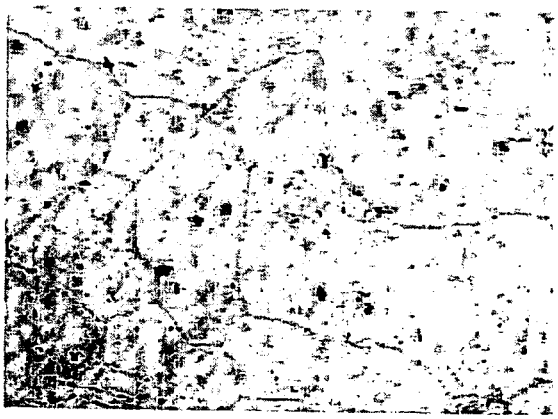

FIG. 8 shows the results of the samples of sample numbers 1 and 4 that are the examples of the present invention shown in the Tables 1 and 2 observed by the optical microscope and the result of the introduced raw material AM60 chip observed by the optical microscope.

FIG. 8(*a*) shows the sample of the sample number 1 in which the maximum crystal grain diameter of the magnesium constituting the matrix is 26 μm and according to the result of image analysis, the average crystal grain diameter is finely granulated to 14.3 μm.

FIG. 8(*b*) shows the sample of the sample number 4 in which the maximum crystal grain diameter of the magnesium constituting the matrix is as small as 11 μm and according to the result of image analysis, the average crystal grain diameter is finely granulated to 7.8 μm.

FIG. 8(*c*) shows the AM60 chip that is the introduced raw material in which the maximum crystal grain diameter of the magnesium constituting the matrix is 350 μm, the minimum crystal grain diameter thereof is 123 μm and the average crystal grain diameter thereof is 218 μm (according to the image analysis).

As is clear from the above results, coarse magnesium-based alloy powder having fine magnesium crystal grain of 30 μm or less can be manufactured by the continuous powder plastic working according to the present invention.

EXAMPLE 2

As a starting raw material, a AM60 (nominal composition: Mg-6% by weight of Al-0.5% by weight of Mn) alloy chip (its length is 3.5 mm, width is 1.5 mm, thickness is 1.2 mm, maximum crystal grain diameter of magnesium of matrix is 350 μm, and average Vickers hardness is 65.4 Hv) was prepared. In addition, a roller compactor having a pair of roll rotation bodies (its roll diameter is 100 mm ϕ, roll width is 80 mm, and the clearance between rolls is 0.5 mm) was used as the continuous powder plastic working apparatus. The AM60 chip was retained at 200° C. in a heating furnace kept in a nitrogen gas atmosphere and supplied to the working apparatus to be compressed and deformed. After the sample discharged from the apparatus had been ground and granulated in a batch apparatus, it is heated and retained at the predetermined temperature again as shown in the Table 1 and then continuously compressed and deformed by the same working apparatus.

Here, the number of passing corresponds to the number of times the AM60 chip is supplied to the roller compactor. The measured results of a maximum crystal grain diameter and Vickers hardness observed by an optical microscope after polished and etched is shown in Table 3.

According to the sample numbers 11 to 16 that are the examples of the present invention, it is recognized that the maximum crystal grain diameter is finely granulated to 30 μm or less as compared with the AM60 chip and the maximum crystal grain diameter is reduced as the number of passing is increased and it can be further finely granulated to 15 μm or less. At the same time, the Vickers hardness is also increased as the high straining process is accumulated. According to the samples to which the batch process was executed after the continuous plastic working, all of them are mixed powder of plate-shape samples and granular samples and the size is 0.3 to 4.5 mm, which satisfies the proper dimensional range defined by the present invention.

TABLE 3

| | | characteristics of powder after batch process | | |
|---|---|---|---|---|
| sample number | number of passing | maximum crystal grain diameter | average hardness (Hv) | Other |
| 11 | 1 | 18 μm | 75.3 | No attachment on the roll surface |
| 12 | 2 | 16 μm | 78.6 | No attachment on the roll surface |
| 13 | 3 | 14 μm | 79.2 | No attachment on the roll surface |
| 14 | 4 | 11 μm | 81.1 | No attachment on the roll surface |
| 15 | 5 | 10 μm | 82.9 | No attachment on the roll surface |
| 16 | 6 | 8 μm | 84.6 | No attachment on the roll surface |

EXAMPLE 3

The samples of the sample numbers 12 and 16 shown in the Table 3 and the introduced raw material AM60 chip were prepared as the starting raw materials and each powder was solidified at the room temperature and a powder compact having a diameter of 35 mm ϕ and a height of 18 mm was manufactured. After each powder compact was heated and retained at 400° C. for 5 minutes in a nitrogen gas atmosphere, hot extruding process was immediately performed (extrusion ratio is 25 and dies temperature is 400° C.), so that a dense magnesium-based alloy rod (diameter is 7 mm ϕ) was manufactured. A tensile test specimen (parallel part is 15 mm and diameter is 3.5 mm ϕ) was manufactured from provided each extruded material and tensile strength characteristics (tensile strength, yield stress, and breaking elongation) were evaluated at the room temperature. The results thereof are shown in Table 4.

The tensile strength, the yield stress and the breaking elongation of the extruded material manufactured using the AM60 magnesium-based alloy powder having a fine structure in which the magnesium maximum crystal grain diameter is 15 μm or less manufactured by the continuous powder plastic working according to the present invention are considerably improved as compared with the case in which the introduced raw material AM60 chip that was not processed by the plastic working was used. As seen from this result, it is recognized that both high strength and ductility of the magnesium-based alloy can be implemented by miniaturizing the magnesium crystal grain using the plastic working method proposed by the present invention.

TABLE 4

| starting raw material sample number | tensile strength (MPa) | yield stress (MPa) | breaking elongation (%) |
|---|---|---|---|
| 12 | 282 | 183 | 12.2 |
| 16 | 304 | 201 | 13.4 |
| AM60 raw material chip | 240 | 145 | 9.2 |

EXAMPLE 4

As a starting raw material, a AM60 (nominal composition : Mg-6% by weight of Al-0.5% by weight of Mn) alloy chip (its length is 3.5 mm, width is 1.5 mm, thickness is 1.2 mm, maximum crystal grain diameter of magnesium of matrix is 350 μm, and average Vickers hardness is 65.4 Hv) was prepared. In addition, a kneader (kneading machine) having a pair of rotation paddles (a clearance between the pair of paddles is 0.3 mm and a clearance between the paddle and a case is 0.3 mm) was used as the continuous powder plastic working apparatus. The AM60 chip was retained at each temperature shown in Table 5 in a heating furnace kept in a nitrogen gas atmosphere and supplied to the working apparatus to be compression deformed and sheared. The sample discharged from the apparatus was ground and granulated by a batch apparatus. The measured results of the configurations and the dimensions of the provided powder samples are shown in Table 5 and the measured results of a maximum crystal grain diameter and Vickers hardness after polished and etched are shown in Table 6.

According to sample numbers 21 to 25 that are the examples of the present invention, it is recognized that the maximum crystal grain diameter of the matrix is miniaturized to 30 μm or less as compared with the inputted raw material AM60 chip and it can be further finely granulated to 15 μm or less by setting the temperature condition appropriately. In addition, it is recognized that the Vickers hardness is increased by the high straining process.

According to the sample number 26 that is a comparison example, since the temperature of the introduced sample AM60 exceeds 350° C. beyond the appropriate range, the sample chip is attached on the paddle and the case inner wall surface during the plastic working process.

TABLE 5

| sample number | temperature of AM60 chip (° C.) | characteristics of powder after batch process | |
|---|---|---|---|
| | | configuration | dimension |
| 21 | room temperature | grain-shape | maximum diameter 1.5 mm, minimum diameter 0.9 mm |
| 22 | 100 | grain-shape | maximum diameter 1.5 mm, minimum diameter 0.9 mm |
| 23 | 150 | grain-shape | maximum diameter 1.5 mm, minimum diameter 0.9 mm |
| 24 | 200 | grain-shape | maximum diameter 1.5 mm, minimum diameter 0.9 mm |
| 25 | 250 | grain-shape | maximum diameter 1.5 mm, minimum diameter 0.9 mm |
| 26 | 340 | grain-shape | maximum diameter 1.5 mm, minimum diameter 0.9 mm |

TABLE 6

| sample number | characteristics of powder after batch process | | |
|---|---|---|---|
| | maximum crystal grain diameter | average hardness (Hv) | Other |
| 21 | 22 μm | 75.2 | No attachment on the roll surface |
| 22 | 13 μm | 83.5 | No attachment on the roll surface |
| 23 | 10 μm | 84.9 | No attachment on the roll surface |
| 24 | 8 μm | 87.5 | No attachment on the roll surface |
| 25 | 12 μm | 83.1 | No attachment on the roll surface |
| 26 | 20 μm | 76.6 | sample chip was attached on the roll surface |

Figure 9:
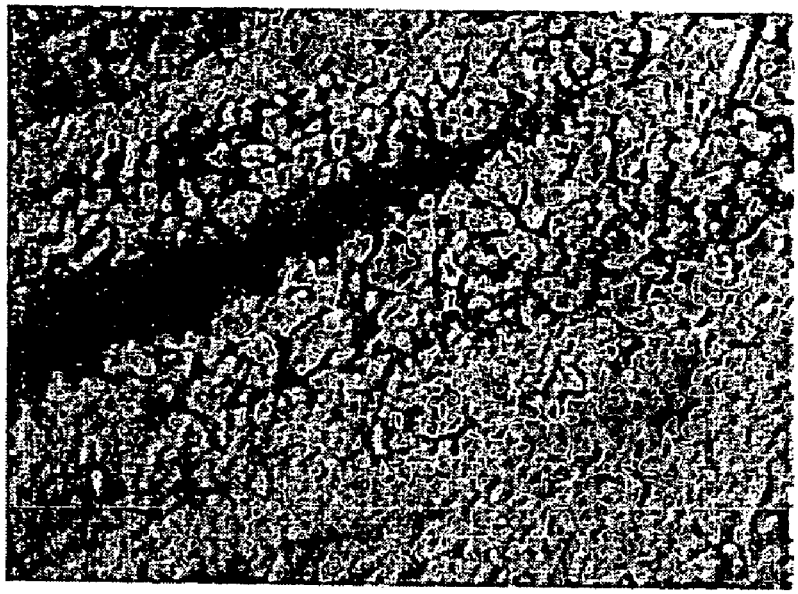
FIG. 9 shows optical micrographs of sample of sample numbers 23 and 24 in Tables 5 and 6.
Figure 9:
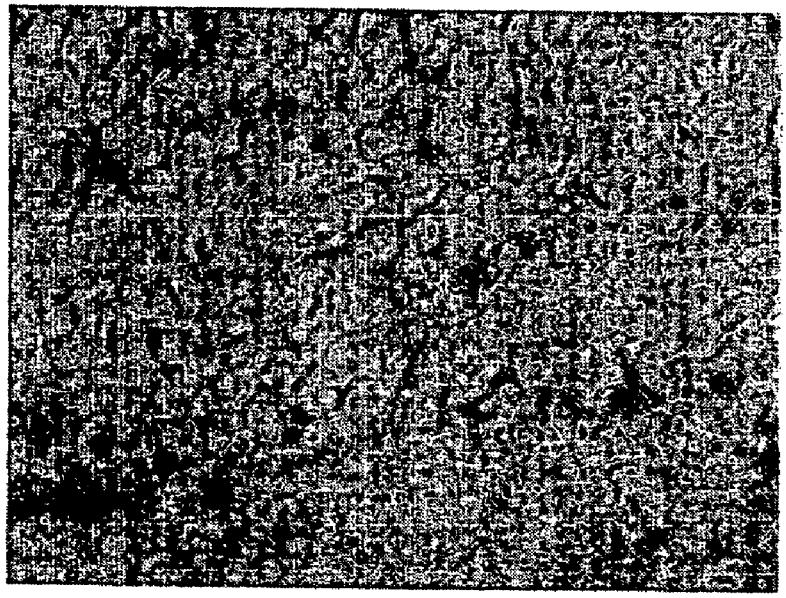

The results of the constitutions of the sample numbers 23 and 24 according to the examples of the present invention shown in Tables 5 and 6 observed by the optical microscope are shown in FIG. 9. According to each magnesium-based alloy powder, the maximum crystal grain diameter of magnesium is as small as 15 μm or less and it is recognized that the coarse magnesium-based alloy powder having fine magnesium crystal grain can be manufactured by the continuous powder plastic working according to the present invention.

EXAMPLE 5

As a starting raw material, a AM60 (nominal composition: Mg-6% by weight of Al-0.5% by weight of Mn) alloy chip (its length is 3.5 mm, width is 1.5 mm, thickness is 1.2 mm, maximum crystal grain diameter of magnesium of matrix is 350 μm, and average Vickers hardness is 65.4 Hv) was prepared. In addition, a roller compactor (a roller shaft is cantilevered) having a pair of roll rotation bodies (a roll diameter is 66 mm ϕ, a roll width is 60 mm, and clearance between the rolls is 0 mm) was used as the continuous powder plastic working apparatus. The temperature of a sample supply port was set to 170° C. and the AM60 chip was retained at 200° C. in a heating furnace kept in a nitrogen gas atmosphere and supplied to the working apparatus to be compressed and deformed. After the sample discharged from the apparatus had been ground and granulated in a batch apparatus, it was heated and retained at 200° C. again and then continuously compressed and deformed by the same working apparatus.

Here, the number of passing corresponds to the number of times the AM60 chip was supplied to the roller compactor. The measured results of the configurations and the dimensions of the provided powder samples are shown in Table 7 and the measured results of a maximum crystal grain diameter and Vickers hardness after polished and etched are shown in Table 8.

According to sample numbers 31 to 36 that are the examples of the present invention, it is recognized that the maximum crystal grain diameter of the matrix is miniaturized to 15 μm or less as compared with the introduced raw material AM60 chip and the AM60 chip can be finely granulated without attachment of the material to the roll surface, by setting the temperature condition appropriately. In addition, it is recognized that the Vickers hardness is increased by the high straining process.

TABLE 7

| sample number | number of passing | characteristics of powder after batch process | |
|---|---|---|---|
| | | configuration | dimension |
| 31 | 1 | plate-shape | length 2.9 mm, width 1.8 mm, thickness 0.31 mm |
| 32 | 2 | plate-shape | length 2.4 mm, width 1.5 mm, thickness 0.34 mm |
| 33 | 3 | plate-shape | length 2.2 mm, width 1.8 mm, thickness 0.41 mm |
| 34 | 4 | plate-shape | length 3.3 mm, width 1.6 mm, thickness 0.34 mm |
| 35 | 5 | plate-shape | length 3.9 mm, width 1.8 mm, thickness 0.33 mm |
| 36 | 6 | plate-shape | length 3.7 mm, width 1.8 mm, thickness 0.35 mm |

TABLE 8

| sample number | characteristics of powder after batch process | | |
|---|---|---|---|
| | maximum crystal grain diameter | average hardness (Hv) | Other |
| 31 | 14 μm | 85.8 | No attachment on the roll surface |
| 32 | 12 μm | 89.6 | No attachment on the roll surface |
| 33 | 12 μm | 91 | No attachment on the roll surface |
| 34 | 11 μm | 94.2 | No attachment on the roll surface |
| 35 | 9 μm | 97.4 | No attachment on the roll surface |
| 36 | 7 μm | 98.6 | No attachment on the roll surface |

INDUSTRIAL APPLICABILITY

The present invention can be advantageously applied to an alloy powder raw material to provide an alloy having both high strength and rigidity, and a manufacturing method thereof.

The invention claimed is:

1. A method of manufacturing magnesium-based alloy granular powder, by which starting magnesium-based alloy powder is processed by plastic working to miniaturize the crystal grain diameter of the matrix of the starting magnesium-based alloy powder, comprising the steps of:

compressing and deforming the starting magnesium-based alloy powder by passing the same through a pair of rolls;

shredding the compressed and deformed magnesium-based alloy powder or its aggregate into granular power particles; and repeating said compressing and deforming process and said shredding process until the maximum size of the powder particle becomes 10 mm or less, the minimum size thereof becomes 0.1 mm or more and the maximum crystal grain diameter of the matrix of the powder particle becomes 30 μm or less.

2. The method according to claim 1, wherein when it is assumed that the maximum crystal grain diameter of the metal or alloy constituting the matrix of the starting raw material powder particle is 100%, said plastic working is performed until the maximum crystal grain diameter of the metal or alloy constituting the matrix of the powder particle after processed becomes 20% or less.

3. The method according to claim 1, wherein said plastic working is performed at 300° C. or lower.

4. The method according to claim 1, wherein said starting powder is heated in an inert gas atmosphere, a non-oxygenated gas atmosphere or a vacuum atmosphere.

5. The method according to claim 1, wherein said pair of rolls is arranged in a case, and said method further comprises a raw material inputting step of continuously inputting the starting powder to the space between the pair of rolls in said case, and a powder discharging step of continuously discharging the powder processed by the plastic working between said pair of rolls outside the case.

6. The method according to claim 5, further comprising a step of processing the powder discharged from said case in at least one machine of a crushing machine, a grinding machine, and a granulating machine continuously to provide granular powder.

7. The method according to claim 1, wherein a plurality of said pairs of rolls are provided and said starting powder is processed by plastic working through said plurality of pairs of rolls.

8. The method according to claim 1, wherein the clearance between said pair of rolls is not more than 2 mm.

9. The method according to claim 1, wherein the surface temperature of said roll with which said starting powder comes into contact is set to 300° C. or lower.

10. The method according to claim 1, wherein a region in which the plastic working is applied including said pair of rolls is in an inert gas atmosphere, a non-oxygenated, or a vacuum atmosphere.

11. The method according to claim 1, wherein said roll has a recessed part on its surface.

* * * * *